US005765570A

United States Patent [19]

Litzinger et al.

[11] Patent Number: 5,765,570

[45] Date of Patent: Jun. 16, 1998

[54] RECONSTITUTED TOBACCO PRODUCT

[75] Inventors: Elmer F. Litzinger; Barid Baran Chakraborty; William R. Conway, all of Louisville, Ky.

[73] Assignee: Brown & Williamson Tobacco Corporation, Louisville, Ky.

[21] Appl. No.: 773,614

[22] Filed: Dec. 30, 1996

Related U.S. Application Data

[63] Continuation of Ser. No. 582,666, Jan. 4, 1996, abandoned, which is a continuation of Ser. No. 322,211, Oct. 13, 1994, abandoned, which is a division of Ser. No. 55,736, Apr. 30, 1993, Pat. No. 5,377,698.

[51] Int. Cl.[6] ..... A24B 3/14

[52] U.S. Cl. ..... 131/370; 131/297

[58] Field of Search ..... 131/553, 356, 131/370, 297, 372, 374

[56] References Cited

U.S. PATENT DOCUMENTS

| | | | |
|---|---|---|---|
| 3,499,454 | 3/1970 | Hind . | |
| 4,987,906 | 1/1991 | Young et al. | 131/297 |
| 5,099,864 | 3/1992 | Young et al. . | |
| 5,143,097 | 9/1992 | Sohn et al. . | |

FOREIGN PATENT DOCUMENTS

| | | |
|---|---|---|
| 0207809 | 1/1987 | European Pat. Off. . |
| 0535834 | 4/1993 | European Pat. Off. . |
| 2256235 | 5/1973 | Germany . |
| 2307974 | 9/1973 | Germany . |
| 1218848 | 1/1971 | United Kingdom . |

*Primary Examiner*—Mickey Yu
*Assistant Examiner*—Kelly O'Hara
*Attorney, Agent, or Firm*—Morgan & Finnegan, LLP

[57] ABSTRACT

A process for the manufacture of a reconstituted tobacco product wherein the process comprises extraction of tobacco furnish with an aqueous solvent in the presence of at least one ammonium salt or urea or a urea derivative or a mixture of urea or a urea derivative and at least one ammonium salt to provide an aqueous solvent extract and a fibrous material and forming the fibrous material into a sheet-like product using the papermaking process. The aqueous extract is then applied to the formed sheet-like material and further processing provides a reconstituted tobacco product having improved smoke quality.

13 Claims, 1 Drawing Sheet

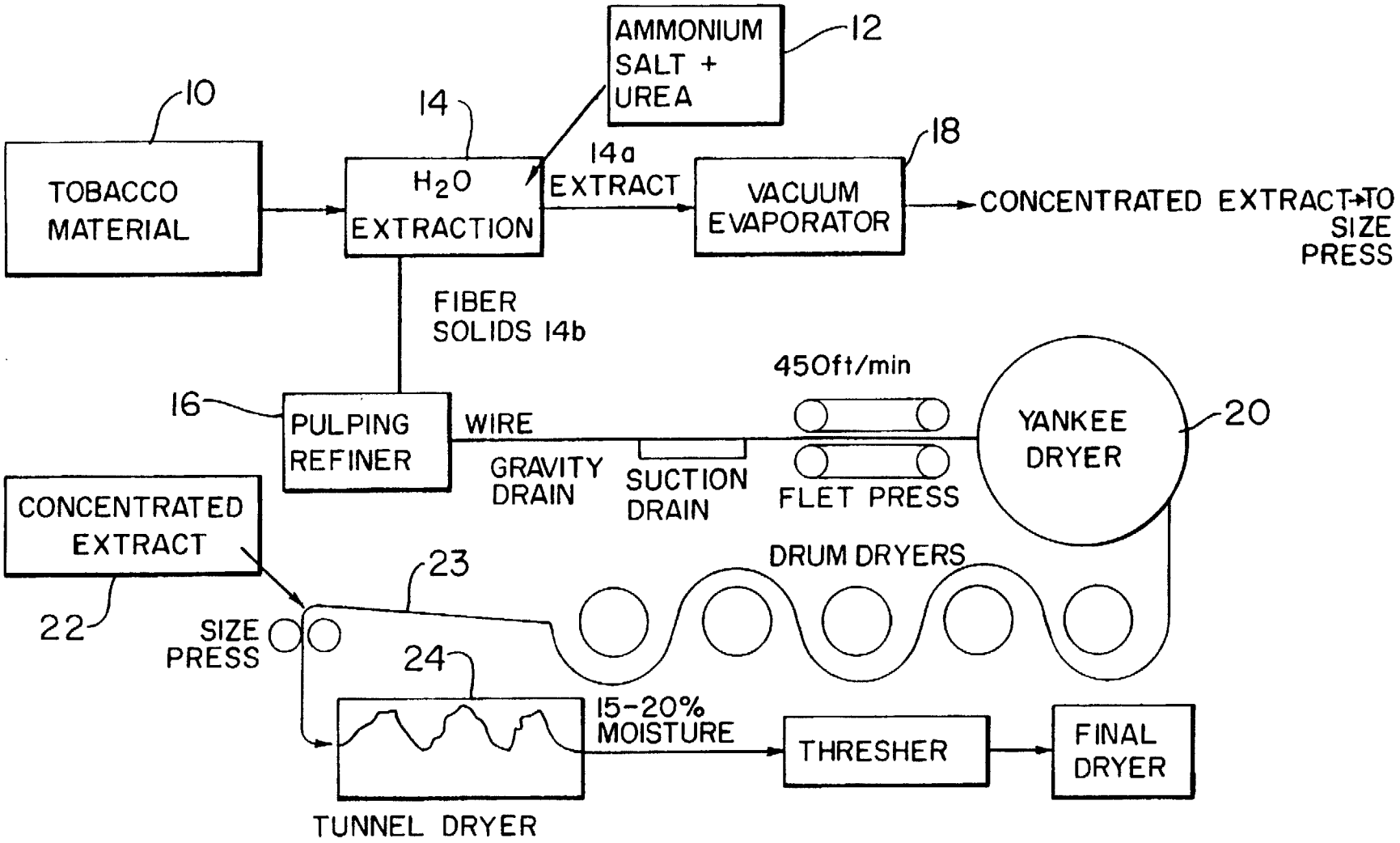
TOBACCO MATERIAL
10
AMMONIUM SALT + UREA
12
$H_2O$ EXTRACTION
14
14a EXTRACT
VACUUM EVAPORATOR
18
CONCENTRATED EXTRACT→TO SIZE PRESS
FIBER SOLIDS 14b
PULPING REFINER
16
WIRE
GRAVITY DRAIN
SUCTION DRAIN
450ft/min
FLET PRESS
YANKEE DRYER
20
DRUM DRYERS
CONCENTRATED EXTRACT
22
SIZE PRESS
23
24
15-20% MOISTURE
TUNNEL DRYER
THRESHER
FINAL DRYER

RECONSTITUTED TOBACCO PRODUCT

This is a continuation of application Ser. No. 08/582,666, filed on Jan. 4, 1996, now abandoned, which is a continuation of application Ser. No. 08/322,211, filed on Oct. 13, 1994, now abandoned, which is a divisional of application Ser. No. 08/055,736 filed Apr. 30, 1993, now U.S. Pat. No. 5,377,698.

FIELD OF THE INVENTION

The present invention relates to improved paper reconstituted tobacco and an improved process for making paper reconstituted tobacco.

BACKGROUND OF THE INVENTION

In the production and process of tobacco products including aging, blending, sheet forming, cutting, drying, cooling, screening, shaping and packaging, considerable amounts of by-products including tobacco fines, stems, and other small tobacco plant parts are produced. Those skilled in the art recognize that such by-products can be combined with binder to form a coherent sheet which resembles leaf tobacco and which sheet is commonly referred to as reconstituted tobacco.

There are basically two commonly but quite different commercially employed processes used for the preparation reconstituted tobacco.

One procedure, referred to commonly as band casting, employs a slurry of finely divided tobacco parts and a binder which is coated onto a steel band and then dried. After drying, the sheet is shredded and used in various tobacco products including as a cigarette filler.

Waste or scrap tobacco parts or dust are normally bound together by providing an adhesive to give the tobacco sheet coherence. Various adhesives or binding agents have been used or proposed for this purpose, many of them being modified cellulose or other non-tobacco derivatives. Improvements in binding agents have led to the use of adhesive material derived from tobacco, notably, tobacco pectins. Such processes are taught in various U.S. patents including U.S. Pat. Nos. 3,353,541; 3,420,241; 3,386,449; 3,760,815 and 4,674,519. Reconstituted tobacco made in the hereinabove mentioned patents is obtained by including a pectin release step in the sheet forming process. The disclosures of the foregoing patents and any patent or literature disclosure noted hereinbelow are expressly incorporated herein by reference.

In the '541, '241 and '449 patents, diammonium phosphate or ammonium orthophosphate is employed in the release of pectins from the tobacco by-products. The '815 patent discloses the use of ammonium salts to release binder from the tobacco by-product.

The second known process employs papermaking techniques. Examples of patents which disclose such reconstituted tobacco processes include U.S. Pat. Nos. 3,428,053; 3,415,253; 3,561,451; 3,467,109; 3,483,874; 3,860,012 and 3,847,164.

In the papermaking process, the soluble ingredients of natural tobacco are extracted. The tobacco may be macerated or comminuted in preparation for extraction. The extraction is normally performed by use of water. The extract is separated, and the insoluble fibers with or without additives are transformed into a self-sustaining web by the usual papermaking technique. The tobacco extract, which may be concentrated to a liquor, is then reapplied into the web. The application of the extracted tobacco material may be achieved in any appropriate manner, as by spraying, saturating, or otherwise.

In the past, materials have been added to the concentrated extract and there has been some limited success with ammonium salts in order to reduce smoke irritation and to form flavor precursors from sugar-ammonia reaction products.

There remains, however, a continuing need for further improvement in tobacco smoke quality and in reducing smoke irritation. Furthermore, there remains a continuing need to obtain an improved papermaking process for the preparation of reconstituted tobacco sheet in which the extraction of natural water soluble materials from the tobacco furnish is enhanced.

It is an object of the present invention to provide a process for the preparation of reconstituted tobacco sheet using the papermaking process in which some of the water insoluble tobacco biopolymers are converted into water soluble materials. Thus, there is an enhanced aqueous extraction of the newly formed solubles as well as solubles indigenous to tobacco.

It is a further object of the present invention to provide a reconstituted tobacco sheet having improved smoke equality.

SUMMARY OF THE INVENTION

The present invention relates to a papermaking process for manufacturing a reconstituted tobacco product in which at least one ammonium salt, or urea or a urea derivative, or a mixture of urea or a urea derivative and at least one ammonium salt are added to the aqueous tobacco furnish extraction step. After extraction, the aqueous extract is separated from the water insoluble fibrous portion, optionally concentrated, and applied to the formed sheet. In the present process, tobacco furnish comprising tobacco stems, fines and other tobacco by-products from tobacco manufacturing processes is extracted using an aqueous solvent in the presence of at least one ammonium salt or urea or a urea derivative, or a mixture of a urea and an ammonium salt. At least a portion of the aqueous solvent extract is separated from the insoluble fibrous portion. The insoluble portion is then formed into a sheet-like web; and the aqueous solvent tobacco extract then is applied to the web and the resulting combination is dried to the desired moisture level thereby providing a reconstituted tobacco material having improved smoke quality. Alternatively, the web may be dried and cut up and the extract can be applied to the cut up product and this material dried to the desired moisture content. Prior to forming into a web, the water insoluble portion can be subjected to the action of a number of mechanical refiners to produce a fibrous pulp. The pulp is formed into a sheet on a papermaking machine. The amount of tobacco furnish suspended in the aqueous solvent is about 1 to 25% tobacco furnish based on the total weight of the mixture.

BRIEF DESCRIPTION OF THE DRAWINGS

The figure is a schematic diagram of steps representative of the present invention.

DETAILED DESCRIPTION OF THE PREFERRED EMBODIMENTS

In the figure tobacco material (furnish) 10 in the form of tobacco stems, fines, other tobacco by-products from tobacco manufacturing processes or the like is contacted with an aqueous solvent in an aqueous solvent extraction phase 14 in the presence of at least one ammonium salt, or urea or a urea derivative, or a mixture of at least one ammonium salt and urea or urea derivative 12. The suspension in the aqueous solvent extraction phase 14 is subjected to a separation (not shown) to provide extracted tobacco components in an aqueous solvent shown as extract 14*a* and an aqueous solvent insoluble phase shown as fiber solids 14*b*. Typically separation techniques include, for example, centrifugation, the use of one or more passes of the mixture from the extraction phase through a screw press or belt presses or similar procedures known to those skilled in the art.

The fiber solids 14*b* from the extraction phase 14 are refined in a pulping refiner 16. Such refiners are those typically used in papermaking and include, for example, disc refiners, conical refiners or similar apparatus. The pulp from the refiner 16 is transferred to a forming apparatus 20 which includes inter alia a wire, gravity drain, suction drain, felt press, Yankee dryer, drum dryers, etc. In the forming apparatus, the pulp is laid onto a wire belt forming a sheet-like shape and excess water is removed by the gravity drain and suction drain and presses. The extract 14*b* can be applied directly to the sheet 23 sometime after sheet formation. Alternatively, the extract 14*b* can be concentrated by use of any known type of concentrator typically a vacuum evaporator 18 and then applied to the sheet 23 at any desirable point in the paper-making process. Preferably, the concentrated extract 22 is applied to the sheet 23 at the size press. The fibrous sheet material having the extract, preferably concentrated extract, applied thereto is passed through a dryer such as a tunnel dryer or a similar apparatus to provide a sheet having a typical moisture content of from about 15 to 20% by weight. Subsequently the sheet is cut to a desired size and/or shape and dried to the desired final moisture content.

The tobacco furnish is contacted with an aqueous solvent wherein the aqueous solvent is primarily water. The water content of the aqueous solvent is usually greater than 50% by weight of the solvent, and preferably greater than 90% by weight of the solvent. Deionized water, distilled water or tap water may be employed. If desired various solvents which are water-miscible can be added. Such solvents include alcohols, such as ethanol. The manner in which the extraction is conducted is not particularly critical. Typical extraction temperature conditions range from about 10° C. to about 100° C. preferably 40° to 70° C. The aqueous solvent/tobacco furnish mixture can be agitated as by stirring, shaking or otherwise mixing the mixture in order to increase the rate of extraction. Typically extraction is carried out for about one-half hour to 6 hours, preferably for about 60 minutes or less and sometimes for about 30 minutes or less.

The amount of tobacco furnish to aqueous solvent varies widely but is usually about 1 to 25% tobacco furnish based on the total weight of the suspension. The amount of aqueous solvent varies with the nature of the solvent, the temperature at which the extraction is carried out and the type of tobacco furnish which is extracted. This amount is easily determinable by routine experimentation.

Separation of the extraction mixture components can be carried out by conventional separation means such as, for example, filtration, centrifugation, pressing or similar known means. The temperature during the separation is not critical and is typically at about or above ambient temperature.

The fiber solids obtained from the extraction step is formed into a sheet by using known papermaking techniques and equipment. After sheet formation excess water is removed from the sheet by passing the sheet through a series of presses, dryers, vacuum boxes or the like.

The aqueous solvent extract mixture is preferably concentrated by evaporation of the aqueous phase such that the concentrated extract includes more than about 20% extracted tobacco soluble solids, preferably from about 25 to 50% extracted tobacco soluble solids, most preferably about 30–40% . . . based upon the weight of the extracted soluble solids and aqueous solvent. Various additives can be introduced into the concentrated extract prior to application to the sheet. Typical additives include, for example, sugar and humectant. The sugar may be cane sugar, preferably inverted cane sugar. Amongst the useful humactants is glycerin.

The aqueous extract is applied to the sheet by various application means including for example by use of a series of sprayers or a series of sizing rollers or other known application means. The manner of application is not particularly critical. After application of the extract the sheet is dried to remove moisture in a generally known manner and the resulting tobacco material has a moisture content after final drying of from about 10 to about 15 weight percent.

The ammonium salts which are useful in the present invention are salts of a lower carboxylic acid, carbonate, bicarbonate, sulfate, sulfamate, chloride, or phosphate, orthophosphate and polyphosphateb. Suitable lower carboxylic acid salts include citrate, pivalate, maleate, malato, lactate, malonate, malonate derivatives, levulinate, valerate, icovalerate, acetate, propionate, butyratef gluconate, tartrate, vanillate, sebacate, laurate, stearate, oleate or the like.

Ammonium orthophosphate, ammonium dihydrogen orthophosphate, and diammonium phosphate or the like include the useful phosphoric acid ammonium salts which can be used in the instant invention. The ammonium salts can be used individually or a mixture of two or more ammonium salts may be used. A typical mixture of salts includes, for example, a mixture of diammonium phosphate and ammonium bicarbonate. The amount of the at least one ammonium salt added to the extraction mixture varies over a wide range but is usually about 1 to 10% and preferably about 1 to 5% by weight of the amount of tobacco furnish being extracted.

When a mixture of ammonium salts and urea or a urea derivative is used, the relative amounts of ammonium salt to urea or urea derivative can vary widely but is usually from about 1:3 to 3:1. The amount of ammonium salt and urea added to the aqueous solvent extraction mixture varies over a wide range but is usually from about 1 to 10% and preferably from about 1 to 5% by weight of the amount of tobacco furnish being extracted. It should be noted that one or more ammonium salts can be used either when only an ammonium salt is used or when the admixture with urea is employed and, if desired, the ammonium salt can be generated in situ.

It has been found in the present invention that a significant improvement in the smoke quality of the tobacco sheet formed is achieved when the urea or urea derivative and at least one ammonium salt are used in combination in the present process.

It is believed that there are a number of occurrences in the present method that lead to much improved smoke quality. Addition of an ammonium salt, such as diamonium phosphate, to the tobacco extraction step allows reaction with the biopolymers comprising the tobacco fibers as well as the tobacco solubles that are conventionally extracted.

The concerted action of urea and diammonium phosphate soften the physically hard and dense tobacco stems, which comprise a large portion of the tobacco furnish, and facilitate reaction.

Diammonium phosphate causes the stem to swell and open by its action on cementing biopolymers giving access to urea to soften the cellulose fibers. The result is more complete extraction of stem solubles and a reduction in the loss of these solubles during subsequent processing. A further benefit of these softening agents is a more uniform sheet using fewer mechanical refiners. Urea also produces ammonia on pyrolysis during cigarette smoking which reacts with irritants, such as acrolein and formaldehyde, in snoke, and thereby reduces smoke irritation.

The invention may be illustrated by the following examples:

EXAMPLE 1

One hundred parts of tobacco furnish comprised of tobacco stems, fines, and other tobacco by-products from tobacco manufacturing processes were added to 1500 parts warn water (160°F.) containing an amount of diammonium phosphate (DAP) corresponding to 3 percent of the tobacco weight. Eaction of the tobacco furnish with water containing DAP was carried out,with agitation, for 30 minutes. At the end of this period, the fibrous residue was separated, refined, and formed into a paper-like sheet by ordinary papermaking techniques. Meanwhile, the extract was concentrated by vacuum evaporation to about 35 percent solids. Sugar and humectant were added to the concentrated extract and the extract, with additives, was applied to the sheet by means of a size press.

EXAMPLE 2

Same as Example 1 except that ammonium bicarbonate (ABC) corresponding to 2 percent of the tobacco weight was added to the extraction water.

EXAMPLE 3

Same as Example 1 except that urea corresponding to 2.5 percent of the tobacco weight was added to the extraction water.

EXAMPLE 4

Same as Example 1 except that a combination of DAP and urea, corresponding to 3 percent DAP and 2.5 percent urea of the tobacco weight, was added to the extraction water.

EXAMPLE 5

Same as Example 1 except that a combination of DAP and ABC, corresponding to 3 percent DAP and 2 percent ABC of the tobacco weight, was added to the extraction water.

The dried, conditioned lab rade reconstituted handsheets made in Examples 4 and 5 were shredded and made into cigarettes at 30 percent inclusion level in a conventional tobacco blend for sensory evaluation by in-house expert smokers.

The combination of DAP and urea (Example 4) dramatically reduced smoke irritation, increased body, and improved taste. The combination of DAP and ABC (Example 5) gave a slightly irritating smoke but provided a pleasant sweet, nutty taste.

Based on the positive smoke quality attributes imparted by the lab made handsheets made according to Example 4 (DAP and urea) and Example 5 (DAP and ABC), these two paper reconstituted tobacco sheets were manufactured in quantities of 2500 to 3500 pounds each. Included in this manufacture was a third sample described below as Example 6.

EXAMPLE 6

Reconstituted tobacco sheet made according to the previously described examples except that a combination of additives corresponding to 3 percent DAP, 2 percent ABC, and 2.5 percent urea of the tobacco weight was added extraction water.

Cigarettes were manufactured in the pilot plant with a common tobacco blend differing only in the reconstituted tobaccos described in Examples 4, 5, and 6 above included in the blend at 12.5 percent level. Thirty cartons each were manufactured as well as 30 cartons of a control cigarette containing paper reconstituted tobacco without the furnish additive treatment.

The cigarettes were smoked by an outside consumer test panel consisting of 33 non-menthol king size cigarette smokers. All three test reconstituted tobaccos were preferred over the control.

All of the references which have been cited in this application are expressly incorporated herein by reference thereto. Although the invention has been described in conjunction with specific embodiments, it is evident that many alternatives and variations will be apparent to those skilled in the art in light of the of foregoing disclosure and description. Accordingly, the invention is intended to embrace all of the alternatives and variations that fall within the spirit and scope of the appended claims.

We claim:

1. A reconstituted tobacco product produced by a method comprising the steps of:

a) extracting natural tobacco with an aqueous solvent in the presence of: 1) urea or; 2) a urea derivative or; 3) a mixture of at least one ammonium salt and urea or; 4) a mixture of at least one ammonium salt and a urea derivative to produce an aqueous solvent extract and a fibrous residue;

b) separating the aqueous solvent extract from the fibrous residue;

c) forming the fibrous residue into a sheet-like material using a papermaking process; and d) applying the aqueous solvent extract to the sheet-like material.

2. A product according to claim 1, wherein the method further comprises the step of concentrating the aqueous solvent extract prior to application to the sheet-like material.

3. A product according to claim 2, comprising extracting the natural tobacco in the presence of urea.

4. A product according to claim 2, wherein the method further comprises cutting up the sheet-like material to form a cut-up material.

5. A product according to claim 4, wherein the method further comprises cutting up the sheet-like material prior to applying the aqueous solvent extract to the sheet-like material and applying the aqueous solvent abstract to the cut up material.

6. A product according to claim 4, wherein the method further comprises drying the cut-up material to a final moisture content.

7. A product according to claim 2, wherein the method comprises extracting the natural tobacco in the presence of urea or a urea derivative.

8. A product according to claim 2, wherein the method comprises extracting the natural tobacco in the presence of at least one ammonium salt and urea or a urea derivative.

9. A product according to claim 8, wherein the ammonium salt is a salt of a lower carboxylic acid, carbonate, bicarbonate, sulfate, sulfamate, phosphate, orthophosphate or polyphosphate.

10. A product according to claim 1, wherein the ammonium salt is a salt of a lower carboxylic acid, carbonate, bicarbonate, sulfate, sulfamate, phosphate, orthophosphate or polyphosphate.

11. A reconstituted tobacco product produced by a method comprising the steps of:

a) extracting natural tobacco with an aqueous solvent in the presence of a mixture of diammonium phosphate and urea to produce an aqueous solvent extract and a fibrous residue;

b) separating the aqueous solvent extract from the fibrous residue;

c) concentrating the aqueous solvent extract prior to application to the sheet-like material;

d) forming the fibrous residue into a sheet-like material using a papermaking process; and e) applying the concentrated aqueous solvent extract to the sheet-like material.

12. A reconstituted tobacco product produced by a method comprising the steps of:

a) extracting natural tobacco with an aqueous solvent in the presence of a mixture of diammonium phosphate, ammonium bicarbonate and urea to produce an aqueous solvent extract and a fibrous residue;

b) separating the aqueous solvent extract from the fibrous residue;

c) concentrating the aqueous solvent extract prior to application to the sheet-like material;

d) forming the fibrous residue into a sheet-like material using a papermaking process; and e) applying the concentrated aqueous solvent extract to the sheet-like material.

13. A reconstituted tobacco product produced by a method comprising the steps of:

a) extracting natural tobacco with an aqueous solvent in the presence of a mixture of diammonium phosphate and ammonium bicarbonate to produce an aqueous solvent extract and a fibrous residue;

b) separating the aqueous solvent extract from the fibrous residue;

c) concentrating the aqueous solvent extract prior to application to the sheet-like material, d) forming the fibrous residue into a sheet-like material using a papermaking process; and e) applying the concentrated aqueous solvent extract to the sheet-like material.

* * * * *